US008056373B2

(12) United States Patent
Kazuma

(10) Patent No.: US 8,056,373 B2
(45) Date of Patent: Nov. 15, 2011

(54) LIGHT-TRANSMITTING SHEET MATERIAL AND METHOD FOR MANUFACTURING THE SAME

(75) Inventor: Kuniharu Kazuma, Fukui (JP)

(73) Assignee: Kazuma, Co., Ltd, Fukui (JP)

( * ) Notice: Subject to any disclaimer, the term of this patent is extended or adjusted under 35 U.S.C. 154(b) by 149 days.

(21) Appl. No.: 12/594,297

(22) PCT Filed: Aug. 21, 2007

(86) PCT No.: PCT/JP2007/066144

§ 371 (c)(1),
(2), (4) Date: Oct. 1, 2009

(87) PCT Pub. No.: WO2008/120406

PCT Pub. Date: Oct. 9, 2008

(65) Prior Publication Data

US 2010/0132896 A1 Jun. 3, 2010

(30) Foreign Application Priority Data

Apr. 2, 2007 (JP) ..... 2007-096884
Aug. 6, 2007 (JP) ..... 2007-204807

(51) Int. Cl.
*D04B 21/06* (2006.01)

(52) U.S. Cl. ..... 66/195; 66/196

(58) Field of Classification Search ..... 66/170, 66/193, 195, 192, 196
See application file for complete search history.

(56) References Cited

U.S. PATENT DOCUMENTS 2,142,900 A * 1/1939 Hinlein et al. ..... 66/170
2,371,039 A * 3/1945 Fischel ..... 160/385
3,864,944 A * 2/1975 Jackson ..... 66/87
4,399,671 A 8/1983 Henningsson
4,626,465 A * 12/1986 Henningsson ..... 442/186
4,632,863 A * 12/1986 Henningsson ..... 442/186
4,811,573 A * 3/1989 Sternlieb ..... 66/193
5,613,540 A * 3/1997 Jelic ..... 160/84.04
5,619,869 A * 4/1997 Tacy ..... 66/195
5,735,145 A * 4/1998 Pernick ..... 66/196
6,212,913 B1 * 4/2001 Weiss ..... 66/172 R
7,415,845 B1 * 8/2008 Graichen ..... 66/170
7,836,936 B2 * 11/2010 Graichen ..... 160/89

FOREIGN PATENT DOCUMENTS

JP 56-88725 A 7/1981
JP 59-47062 B2 11/1984
JP 6-47585 U 6/1994
JP 2001-172841 A 6/2001
JP 2002-54050 A 2/2002

* cited by examiner

*Primary Examiner* — Danny Worrell
(74) *Attorney, Agent, or Firm* — Sughrue Mion, PLLC

(57) ABSTRACT

An object of the present invention is to provide a light-transmitting sheet material capable of transmitting sufficient amount of light and providing high blinding effect. A sheet material (1) includes a front fabric (2), a back fabric (3), and light-shielding layers (4), and is shaped such that the front fabric (2) and the back fabric (3) are held with a predetermined distance therebetween by fixing entire constituent yarns by resin treatment. The front fabric (2) and the back fabric (3) are formed into a planar shape by arranging stitch rows of chain stitches, knitted in a warp direction, in a weft direction at a predetermined interval and by knitting an insertion yarn alternately in adjoining stitch rows by a predetermined length. The light-shielding layers (4) are formed into sheet-like structures in the warp direction by knitting a connecting yarn alternately between the stitch rows of the front fabric (2) and the back fabric (3), and the plurality of light-shielding layers (4) are arranged in parallel in the weft direction.

4 Claims, 8 Drawing Sheets

LIGHT-TRANSMITTING SHEET MATERIAL AND METHOD FOR MANUFACTURING THE SAME

TECHNICAL FIELD

The present invention relates to light-transmitting knitted sheet materials used for blinds and shades installed in rooms and cars, and methods for manufacturing the same.

BACKGROUND ART

The above-mentioned blinds and shades are installed to block outside light entering rooms or cars. Depending on the purpose, various materials, such as metal plates, resin plates, and fabrics are used for light-shielding members. Among those, fabrics including wovens and knits can be used as interior design products, whereby various types of fabrics have been proposed. For example, Patent Document 1 discloses that a three-dimensional knit fabric having honeycomb-like gaps is used for a corrugated screen of a vertical blind. Patent Document 2 discloses a double-layer curtain fabric in which a front knitted fabric and a back knitted fabric are connected by a connecting yarn so as to form a plush layer formed of a plush portion of the connecting yarn between the front knitted fabric and the back knitted fabric. Patent Document 3 discloses that a plurality of yarn rows having a length capable of holding a pair of fabrics with a predetermined distance therebetween are provided, and the yarn rows include multiple rows of yarn woven into a base fabric, which are and arranged in a sheet-like structure. Patent Document 4 discloses a knitted fabric for blinds in which front and back knitting structures are knitted from chain stitch yarns and insertion yarns such that a predetermined distance is maintained therebetween and a knitted portion formed by obliquely passing another yarn is formed between the front and the back.

[Patent Document 1] Japanese Unexamined Patent Application Publication No. 9-228764

[Patent Document 2] Japanese Unexamined Patent Application Publication No. 2001-172841

[Patent Document 3] Japanese Unexamined Patent Application Publication No. 2002-54050

[Patent Document 4] Japanese Examined Utility Model Registration Application Publication No. 7-2633

DISCLOSURE OF INVENTION

Problems to be Solved by the Invention

In the above-described Patent Documents, light-shielding portions are formed of woven or knitted structures from yarns. However, if the light-shielding portion is formed so as not to transmit light, as in Patent Document 4, it has to be folded every time outside light is let into the room. Thus, it is not efficient from the standpoint of usability. In Patent Documents 2 and 3, the light-shielding portions are configured to be movable and, when outside light is let into the room, the movable portions are rotated in a direction in which they are opened. However, because they are made of fabric, there is a problem in that, if the widths increase, the central portions slacken and there is a problem in durability in that, if they are repeatedly rotated, the movable portions are damaged. In Patent Document 1, the amount of transmitted light can be adjusted by the angle of the three-dimensional knit fabric. However, because the light enters through the honeycomb-like gaps, it is difficult to let sufficient amount of light in. In Patent Document 4, although the insertion yarn guided in the weft direction is knitted in the chain stitch rows of the front side knitting structure, such an insertion yarn is not knitted in the back side knitting structure. Thus, the entire knitted fabric is low in strength and is easily deformed, causing variations in the amount of transmitted light.

In view of the foregoing, an object of the present invention is to provide a light-transmitting sheet material capable of transmitting sufficient amount of light and providing high blinding effect.

Means for Solving the Problems

A light-transmitting sheet material of the present invention includes: a front fabric and a back fabric formed by arranging a plurality of stitch rows of chain stitches, knitted in a warp direction, in a weft direction at a predetermined interval and by knitting an insertion yarn alternately in adjoining stitch rows by a predetermined length; and a plurality of light-shielding layers, being formed into sheet-like structures in the warp direction by knitting a connecting yarn alternately between the stitch rows of the front and back fabrics, arranged in the weft direction. The stitch rows of the front and back fabrics opposed to each other are connected to the adjoining light-shielding layers. The light-shielding layers are formed between the stitch rows of the front and back fabrics, being opposed to each other, located at positions shifted from each other. Entire constituent yarns are fixed by resin treatment so that the front and back fabrics are held with a predetermined distance therebetween. In addition, the front and back fabrics are knitted in such a manner that a pair of the insertion yarns are passed between the adjoining stitch rows while being guided in the weft direction so as to intersect each other and are formed into a grid-like structure with the stitch rows in the warp direction and the insertion yarns in the weft direction.

A blind of the present invention includes a plurality of slats that are formed of the above-described light-transmitting sheet material and are formed into a belt-like shape in which the stitch rows extend in a longitudinal direction.

A method for producing a light-transmitting sheet material of the present invention includes: knitting a knitted fabric including a front fabric and a back fabric formed by arranging a plurality of stitch rows of chain stitches, knitted in a warp direction, in a weft direction at a predetermined interval, knitting an insertion yarn alternately in adjoining stitch rows by a predetermined length, and passing a pair of the insertion yarns between the adjoining stitch rows while guiding them in the weft direction so as to intersect each other and a plurality of light-shielding layers, being formed into sheet-like structures in the warp direction by knitting a connecting yarn alternately between the stitch rows of the front and back fabrics, arranged in the weft direction; impregnating the resulting knitted fabric with a resin material; applying tensile force in the weft direction to the knitted fabric impregnated with the resin material, thereby causing the stitch rows of the front and back fabrics to be stretched linearly in the warp direction and the insertion yarns to be stretched linearly between the adjoining stitch rows in the weft direction so as to be formed into a grid-like structure; setting the resin material while the front and back fabrics are held with a predetermined distance therebetween; and fixing and shaping entire constituent yarns of the knitted fabric such that the stitch rows of the front and back fabrics opposed to each other are connected to the adjoining light-shielding layers and such that the light-shielding layers are formed between the stitch rows of the front and back fabrics, being opposed to each other, located at positions shifted from each other.

Advantages

In the above-described structure, there is nothing that blocks incident light between the stitch rows of the front and back fabrics, arranged in the weft direction at a predetermined interval, except for the thin insertion yarns. Thus, sufficient amount of light can be transmitted through the gaps therebetween. Furthermore, because the light-shielding layers are formed into sheet-like structures in the warp direction by knitting the connecting yarn alternately between the stitch rows of the front and back fabrics, the light transmitted between the stitch rows in the surface direction of the light-shielding layers is not blocked. Thus, sufficient amount of light is transmitted in the surface direction of the light-shielding layers.

In addition, because the stitch rows of the front and back fabrics opposed to each other are connected to the adjoining light-shielding layers and the light-shielding layers are formed between the stitch rows of the front and back fabrics, being opposed to each other, located at positions shifted from each other, light incident in the direction in which the stitch rows, being opposed to each other, of the front and back fabrics are opposed to each other is substantially blocked by the light-shielding layers, whereby high blinding effect can be obtained.

Moreover, because the difference in the amount of light is great between the surface direction of the light-shielding layers and the direction in which the stitch rows are opposed to each other, the brightness/darkness contrast is clearly observed depending on the angle of view, whereby an advantage as an interior design product can be obtained.

In addition, because the entire constituent yarns are fixed by resin treatment so that the front and back fabrics are held with a predetermined distance therebetween, the sheet material has no movable portions. This improves the strength and durability, and, when it is used as, for example, the slats of a blind or a sunshade for the interior of a car, no deformation or degradation occurs. Furthermore, because it has a structure in which the stitch rows of chain stitches are connected by the connecting yarn, the strength against compression and twisting in the thickness direction is improved.

Moreover, the front and back fabrics are knitted into a grid-like structure with the stitch rows in the warp direction and the insertion yarns in the weft direction by passing the pair of insertion yarns between the adjoining stitch rows while guiding them in the weft direction so as to intersect each other. Furthermore, because the insertion yarns are knitted in the stitch rows in the warp direction and the insertion yarns are passed twice in the weft direction, it is possible to improve the strength of the front and back fabrics and to further improve the shape retaining property, while ensuring the light transmission property. In addition, because the pair of insertion yarns are knitted while being guided in the weft direction so as to intersect each other, by applying tensile force in the weft direction to the entire knitted fabric so that the insertion yarns are stretched tight, the entirety of the front and back fabrics can be easily formed into a grid-like structure.

Because the blind of the present invention includes a plurality of slats that are formed of the light-transmitting sheet material and are formed into a belt-like shape in which the stitch rows extend in the longitudinal direction, it is possible to transmit light by rotating the slats about the axes extending in the longitudinal direction so that the surface direction of the light-shielding layers of the slats faces frontward, and it is possible to block light by making the direction in which the stitch rows are opposed to each other face frontward, whereby it has high blinding effect and can increase the brightness/darkness contrast by transmitting sufficient light.

Such a blind can express the magnificence and texture of thick curtains as well as the lightness and transparency of lace curtains, depending on the rotation direction of the slats formed of the light-transmitting sheet material, and can be used as a novel interior design product capable of coping with various situations.

BEST MODES FOR CARRYING OUT THE INVENTION

Embodiments of the present invention will be described in detail below. Because the embodiments described below are preferred examples for embodying the present invention, various technical limitations are made. However, the present invention is not limited to those embodiments unless it is stated to be limited in the following description.

FIG. 1 is a perspective view of an embodiment of the present invention, and FIG. 2 is a front view thereof (FIG. 2A) and a sectional view thereof (FIG. 2B). A sheet material 1 includes a front fabric 2, a back fabric 3, and light-shielding layers 4. The front fabric 2 and the back fabric 3 are held with a predetermined distance therebetween by fixing the entire constituent yarns by resin treatment.

The front fabric 2 is formed into a planar shape by arranging stitch rows 20, formed in the warp direction by chain stitches, in the weft direction at a predetermined interval and knitting insertion yarns 21 alternately in the adjoining stitch rows 20 by a predetermined length. Thus, the front fabric 2 is formed in a grid-like structure with the stitch rows 20 extending linearly in the warp direction and the insertion yarns 21 arranged to pass between the adjoining stitch rows 20 while being guided in the weft direction.

Similarly, the back fabric 3 is formed into a planar shape by arranging stitch rows 30, formed in the warp direction by chain stitches, in the weft direction at a predetermined interval and knitting insertion yarns 31 alternately in the adjoining stitch rows 30 by a predetermined length. Thus, the front fabric 3 is formed in a grid-like structure with the stitch rows 30 extending linearly in the warp direction and the insertion yarns 31 arranged to pass between the adjoining stitch rows 30 while being guided in the weft direction.

FIG. 3 is a schematic view showing the knitting structure of the front fabric 2 and the back fabric 3. Between the adjoining stitch rows 20, a pair of insertion yarns 21*a* and 21*b* are knitted alternately in the stitch rows 20 by a predetermined length, while being guided in the weft direction, and the stitch rows 20 in the warp direction and the insertion yarns 21 in the weft direction form a grid-like structure. Because the pair of insertion yarns 21*a* and 21*b* are guided in the opposite directions in the weft direction so as to intersect each other between the stitch rows 20, both the insertion yarns 21*a* and 21*b* are knitted in the stitch rows 20 in the warp direction, and both the insertion yarns 21 are passed in the weft direction so as to intersect each other. Thus, the strength of the entire knitted fabric is improved to increase the shape retaining property, and the light transmission property of the front fabric 2 and back fabric 3 is ensured. Accordingly, as will be described below, also in the case where the sheet material 1 is formed into a belt-like shape along the stitch rows 20, the grid shape formed by the stitch rows 20 and the insertion yarns 21 is hardly deformed, whereby the light transmission property can be stably maintained.

The stitch rows 20 of the front fabric 2 are opposed to the stitch rows 30 of the back fabric 3 and, as shown in FIG. 2A, when viewed from the front, the front fabric 2 and the back fabric 3 are disposed so as to overlap each other.

The light-shielding layers 4 are formed into sheet-like structures in the warp direction by knitting the connecting yarn alternately into the stitch rows 20 of the front fabric 2 and the stitch rows 30 of the back fabric 3, and the plurality of light-shielding layers 4 are arranged in parallel in the weft direction. The connecting yarn constituting the light-shielding layers 4 is arranged closely so as to provide a light-shielding property. By using a bulky yarn, such as a crimp yarn, as the connecting yarn, the light-shielding property can be further improved.

As shown in FIG. 2B, the light-shielding layers 4 connect between the stitch rows 20 of the front fabric 2 and the stitch rows 30 of the back fabric 3, being opposed to each other, located at positions shifted by one row from each other. The adjoining light-shielding layers 4 are connected at one end to the stitch rows 20 of the front fabric 2 and are connected at the other end to the stitch rows 30 of the back fabric 3 that are opposed to the front fabric 2. Therefore, as shown in FIG. 2A, when viewed from the front, the light-shielding layers 4 are exposed over the entire surface, and the entire surface of the sheet material 1 is in a light-shielding state. When viewed from the angle along the surfaces of the light-shielding layers 4, the brightness/darkness contrast can be increased because of the light transmitted through the light-shielding layers 4.

FIG. 4 is a knitting structure diagram according to this embodiment. Reference numerals L1 and L2 denote the insertion yarns 21 of the front fabric 2, and a reference numeral L3 denotes the stitch row 20 of the front fabric 2 knitted by chain stitches. As shown in the figure, L1 and L2, which are the pair of insertion yarns 21, are knitted alternately in the adjoining stitch rows 20 by a predetermined length and are passed between the adjoining stitch rows 20 so as to intersect each other.

Reference numerals L4 and L5 denote knitting yarns for forming edges on both ends and, as will be described below, are used to fix both ends of the knitted fabric to conveyance pins to be stretched in a shaping process. A reference numeral L6 denotes the connecting yarn that is knitted alternately in the loops of the stitch rows 20 and 30.

A reference numeral L7 denotes the stitch row 30 of the back fabric 3 knitted by chain stitches, and reference numerals L8 and L9 denote the insertion yarns 31 of the back fabric 3. Similarly to the front fabric 2, L8 and L9, which are the pair of insertion yarns 31, are knitted alternately in the adjoining stitch rows 30 by a predetermined length and are passed between the adjoining stitch rows 30 so as to intersect each other.

FIG. 5 is a schematic structural diagram concerning a double raschel machine for knitting. To knit the front fabric 2, a front needle 50, a trick plate 51, and a stitch comb 52 are provided, and to knit the back fabric 3, a back needle 60, a trick plate 61, and a stitch comb 62 are provided. While guides L1 to L9 swing, the front needle 50 and back needle 60 knit the front fabric 2 and back fabric 3, and the connecting yarn is alternately hooked on both needles and is knitted therein.

Examples of the knitting yarn used for the front fabric 2 and the back fabric 3 include regenerated fiber such as rayon, natural fiber such as cotton, semi-synthetic fiber such as acetate, polyester synthetic fiber such as polyethylene terephthalate, aliphatic polyamide synthetic fiber such as nylon, and blend fiber of the aforementioned fibers, and may be either filament yarn or spun yarn; it is not specifically limited.

For the connecting yarn, a bulky yarn, for example, a crimp yarn composed of synthetic fiber, e.g., polyester synthetic fiber such as polyethylene terephthalate and aliphatic polyamide synthetic fiber such as nylon is desirable. The use of such yarn can improve the light-shielding property when knitted into sheet-like structures as light-shielding layers.

FIG. 6 is a process for shaping the knitted fabric knitted as shown in FIG. 4 by fixing the constituent yarns by resin treatment. According to the necessity, the knitted fabric is dyed and refined. Then, the knitted fabric serving as the sheet material 1 is transferred by rollers into a liquid tank 100 containing liquid resin, and the knitted fabric is impregnated with the resin material. Preferred examples of the resin material for impregnation include acrylic resin, polyurethane resin, polyester resin, silicon resin, and melamine resin.

The impregnated knitted fabric is squeezed by squeezing rollers 101 to remove excess liquid resin, and is then conveyed into a dryer 102. In the dryer 102, the knitted fabric is dried in a stretched state by being hooked on the pins at both side edges. In a drying step, it is adequate to perform drying at 150° C. for 2 to 3 minutes. Because the knitted fabric is dried in a stretched state by being pulled at both side edges, the insertion yarns passed between the adjoining stitch rows are stretched tight, causing the stitch rows of the front and back fabrics to linearly extend in the warp direction and the insertion yarns to linearly extend in the weft direction so as to be formed into a grid-like structure, and the constituent yarns are fixed and shaped in a state in which the front and back fabrics are held with a predetermined distance therebetween.

FIG. 7 is a perspective view of another embodiment of the present invention, and FIG. 8 is a front view thereof (FIG. 8A) and a sectional view thereof (FIG. 8B). A sheet material 1' includes a front fabric 2', a back fabric 3', and light-shielding layers 4'. Similarly to FIG. 1, the entire constituent yarns are fixed by resin treatment so that the front fabric 2' and the back fabric 3' are held with a predetermined distance therebetween.

In this example, as shown in FIG. 8B, the light-shielding layers 4' are connected to the stitch rows 20' of the front fabric 2' and the stitch rows 30' of the back fabric 3' at intervals of two loops and are formed obliquely between the stitch rows located at positions shifted by two rows from each other. Thus, although the distance between the light-shielding layers 4' is larger than that in FIG. 1, the width of the light-shielding layers 4' increases by just that much, and, by arranging the stitch rows to which the adjoining light-shielding layers 4' are connected so as to oppose to each other, as shown in FIG. 8A, when viewed from the front, the light-shielding layers 4' are exposed over the entire surface and block light without leaving gaps. When viewed from the angle along the surface direction of the light-shielding layers 4', the amount of transmitted light increases by the amount that the distance between the light-shielding layers 4' increases. Thus, the brightness/darkness contrast can be further increased.

When knitting the knitted fabric shown in FIG. 7, by increasing the distance of the connecting yarn L6 in the knitting structure diagram in FIG. 4, the width of the light-shielding layers 4' can be increased.

FIG. 9 is a perspective view of a blind 200, and FIG. 10 is a sectional view taken along line A-A. The blind 200 includes a plurality of vertically suspended slats 201 that are formed by cutting the sheet material 1 into a belt-like shape in which the stitch rows extend in the longitudinal direction. The slats 201 are attached to a known rotational operation mechanism 202 at upper ends and are rotatable about vertical rotation axes.

FIG. 9 shows a state in which the blind 200 is open to the incident light S, and, as shown in FIG. 10, by making the surface direction of the light-shielding layers conform to the incident direction of the incident light S, when viewed from the front of the blind 200, light is transmitted from the entire surface.

FIG. 11 shows a state in which the blind 200 is closed to the incident light S, and FIG. 12 is a sectional view taken along line B-B. When the slats 201 are rotated by about 90 degrees from the state in FIG. 8 to close the blind 200, the light-shielding layers block the incident light S. Thus, when viewed from the front of the blind 200, the incident light S is blocked at the entire surface.

FIG. 13 is a diagram for explaining a light-shielding effect when the slats 201 of the blind 200 are rotated. The blind 200 has the shape of a vertical blind and has functions of both conventional vertical blind and lace curtain. That is, although it is possible to view the outside of the room through the blind from the inside of the room when the outside of the room is bright, such as in the daytime, it is difficult to view the inside of the room from the outside of the room because of the blind. The blind allows the air to flow in and light to enter from the outside of the room, and does not block them.

FIG. 13A shows a case in which the slats 201 are set substantially orthogonal (rotation angle: 0 degrees) when viewed from the front. When the blind 200 is viewed from the front, the outside light is blocked by the light-shielding layers and does not enter. However, because the outside light from the surface direction of the light-shielding layers enters the room, a dimly light state as a thick curtain is provided.

FIG. 13B shows a state in which the slats 201 are rotated counterclockwise from the state in FIG. 12A and are opened halfway. When the blind 200 is viewed from the front, the surface direction of the light-shielding layers conforms to the incident direction of the outside light, increasing the amount of incident light. Accordingly, the light transmission property as a lace curtain can be realized.

FIG. 13C shows a state in which the slats 201 are fully opened (rotation angle: about 90 degrees). When the blind 200 is viewed from the front, the surface direction of the slats 201 conforms to the incident direction of the outside light. Thus, the outside light enters almost without being blocked, making the inside of the room light as if a curtain is drawn.

FIG. 13D shows a state in which the slats 201 are further rotated counterclockwise from the state in FIG. 13C and are opened halfway. When the blind 200 is viewed from the front, the surface direction of the light-shielding layers is orthogonal to the incident direction of the outside light and the outside light is blocked. However, the outside light enters between the slats 201, making the inside of the room lighter than FIG. 13A and darker than FIG. 13B.

FIG. 13E shows a state in which the slats 201 are inverted from the state in FIG. 13A (rotation angle: about 180 degrees). Similarly to FIG. 13A, when the blind 200 is viewed from the front, the outside light is blocked by the light-shielding layers and does not enter. However, because the outside light from the surface direction of the light-shielding layers enters the room, a dimly light state as a thick curtain is provided.

As has been described above, by using the sheet material of the present invention for the slats of blinds, it can be used as an interior design product capable of gradually adjusting the brightness/darkness contrast by rotating the slats, capable of achieving the texture of thick curtains as well as the transparency of lace curtains, and capable of dimming or blocking light in accordance with various situations. Furthermore, by changing the angle of the light-shielding layers with respect to the surface direction of the sheet material, the light-shielding property and the light transmission property can be changed. For example, the light transmission property can be increased by increasing the angle of the light-shielding layers with respect to the surface direction, and the light-shielding property can be increased by reducing that with respect to the surface direction.

FIG. 14 is a perspective view of a blind 300, and FIG. 15 is a sectional view taken along line C-C. The blind 300 includes a plurality of horizontally installed slats 301, being arranged vertically, that are formed by cutting the sheet material 1 into a belt-like shape in which the stitch rows extend in the longitudinal direction and has the shape of a horizontal blind.

FIG. 14 shows a state in which the blind 300 is open to the incident light S. As shown in FIG. 15, by making the surface direction of the light-shielding layers conform to the incident direction of the incident light S, when viewed from the front of the blind 300, light is transmitted from the entire surface.

FIG. 16 shows a state in which the blind 300 is closed to the incident light S, and FIG. 17 is a sectional view taken along line D-D. When slats 301 are rotated to close the blind 300, the light-shielding layers block the incident light S. Thus, when viewed from the front of the blind 300, the incident light S is blocked by the entire surface.

The blind 300 can also provide great brightness/darkness contrast between an open state and a closed state, and is preferable as an interior design product.

EXAMPLE

Using the double raschel machine shown in FIG. 5, the knitted fabric according to the embodiment, shown in FIG. 7, was knitted. Filament yarn of 110 dtex, composed of polyester fiber, was used as the knitting yarn for the front and back fabrics, and woolly finished yarn of 300 dtex, composed of polyester fiber, was used as the connecting yarn. The fabric was knitted in nine gauges and had a weight per unit area of 26.55 kg.

Then, using an acrylic resin material as the liquid resin, the resin treatment shown in FIG. 6 was performed to fix and shape the constituent yarns of the entire knitted fabric. It was confirmed that, although the shaped sheet material transmitted sufficient amount of light from between the light-shielding layers when viewed in the surface direction of the light-shielding layers, when the sheet material was rotated and viewed from the front, the light-shielding layers were exposed over the entire surface and blocked the light, increasing the brightness/darkness contrast.

INDUSTRIAL APPLICABILITY

The sheet material of the present invention is suitable for blinds and shades since it provides great brightness/darkness contrast between the light-shielding property and the light transmission property. For example, when it is used for a sunshade to be attached to the interior of a car, by bringing it into close contact with the inner surface of the window, light entering the car can be blocked.

EXPLANATION OF REFERENCE NUMERALS

Figure 1:
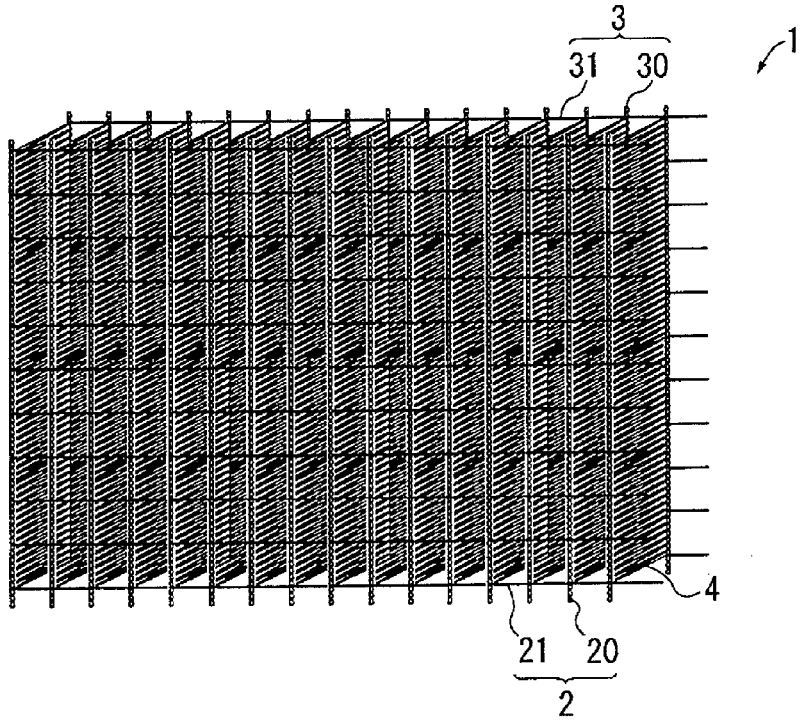
FIG. 1 is a perspective view of an embodiment of the present invention.
Figure 2A:
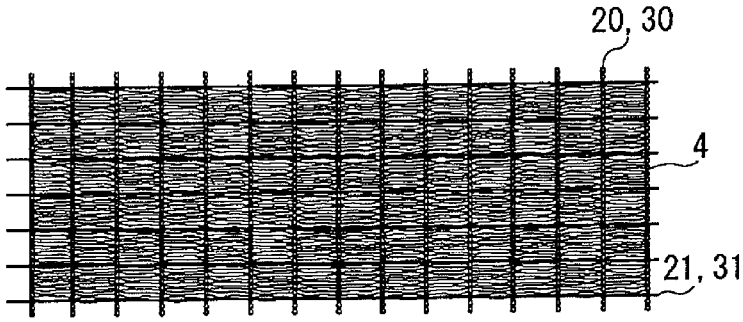
FIG. 2 is a front view and a sectional view of the embodiment shown in FIG. 1.
Figure 2B:
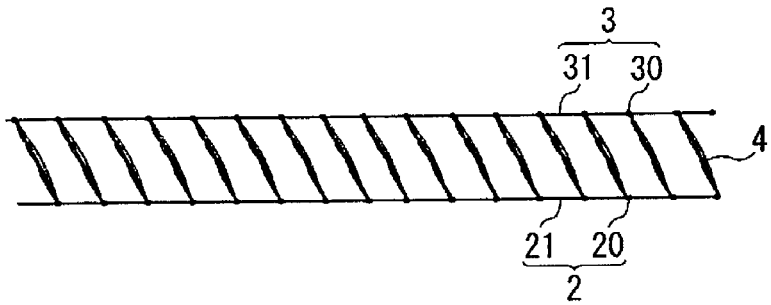
Figure 3:
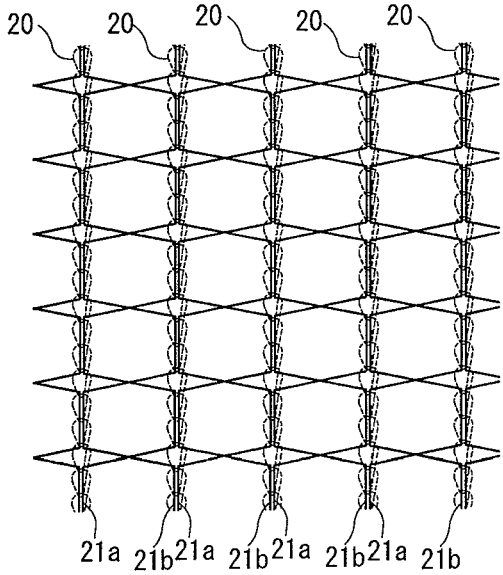
FIG. 3 is a schematic view of a knitting structure of a front fabric and a back fabric according to the embodiment shown in FIG. 1.
Figure 4:
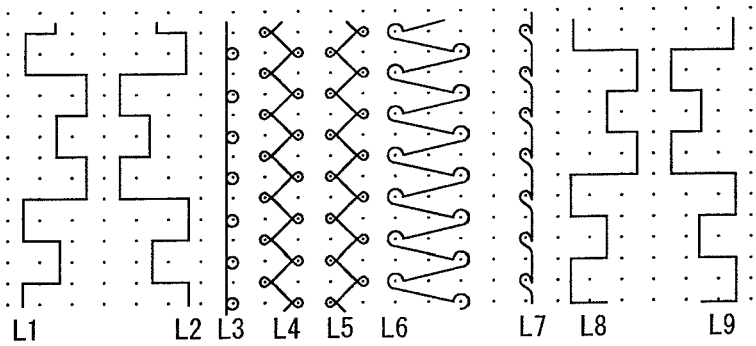
FIG. 4 is a knitting structure diagram of the embodiment shown in FIG. 1.
Figure 5:
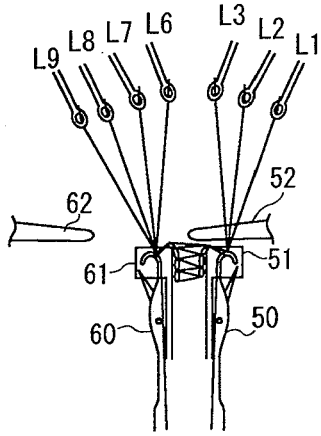
FIG. 5 is a schematic structural diagram of a double raschel machine.
Figure 6:
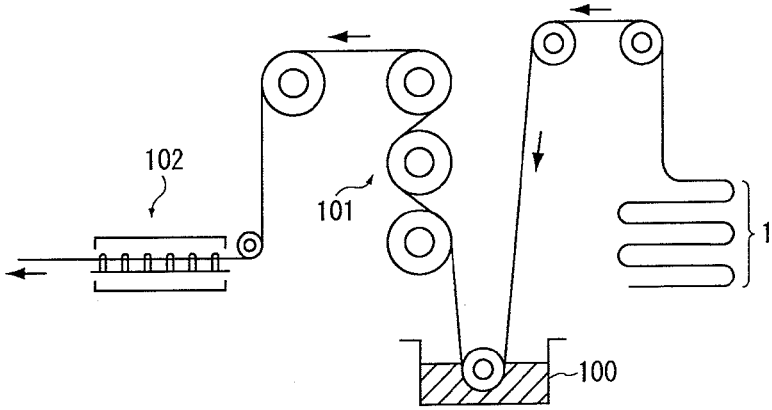
FIG. 6 shows a shaping process of a sheet material.
Figure 7:
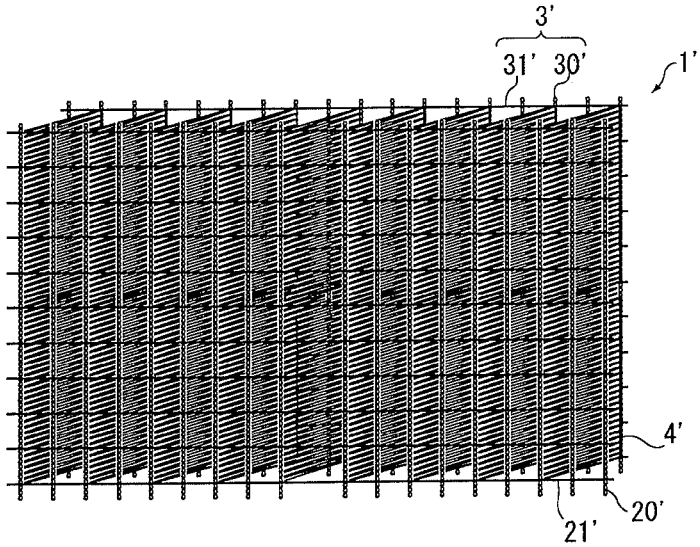
FIG. 7 is a perspective view according to another embodiment of the present invention.
Figure 8A:
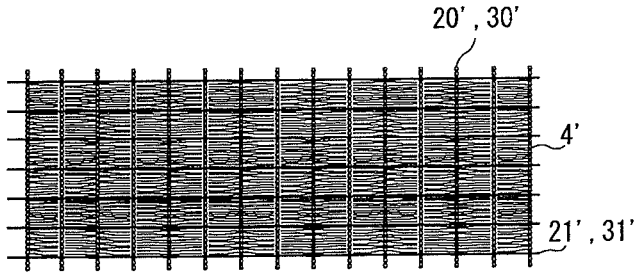
FIG. 8 is a front view and a sectional view of the embodiment shown in FIG. 7.
Figure 8B:
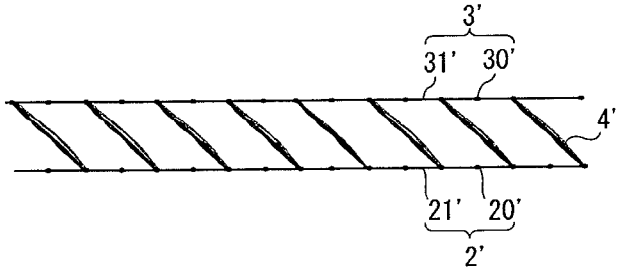
Figure 9:
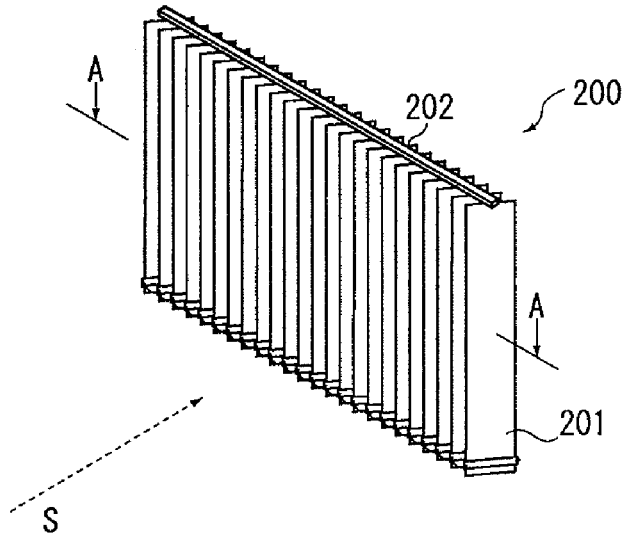
FIG. 9 is a perspective view of a blind.
Figure 10:
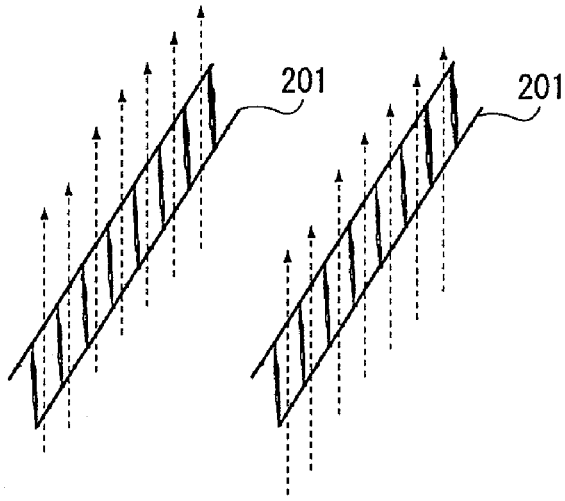
FIG. 10 is a sectional view of the blind shown in FIG. 9.
Figure 11:
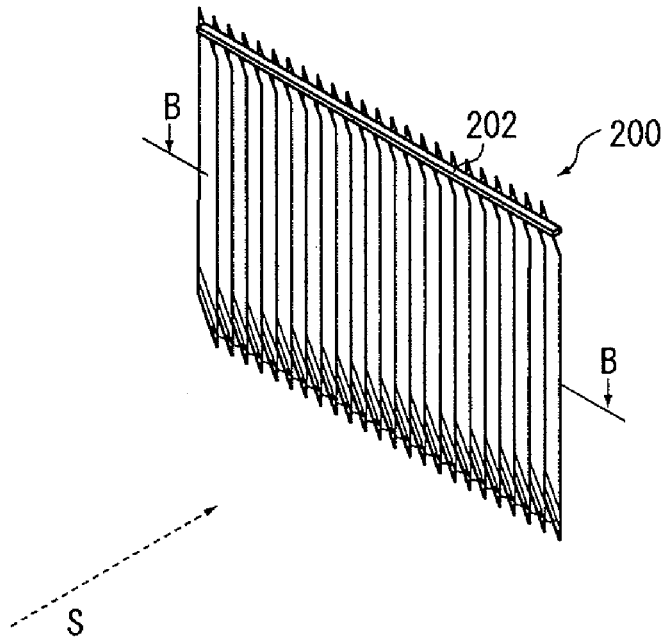
FIG. 11 is a perspective view showing the blind shown in FIG. 9, in a closed state.
Figure 12:
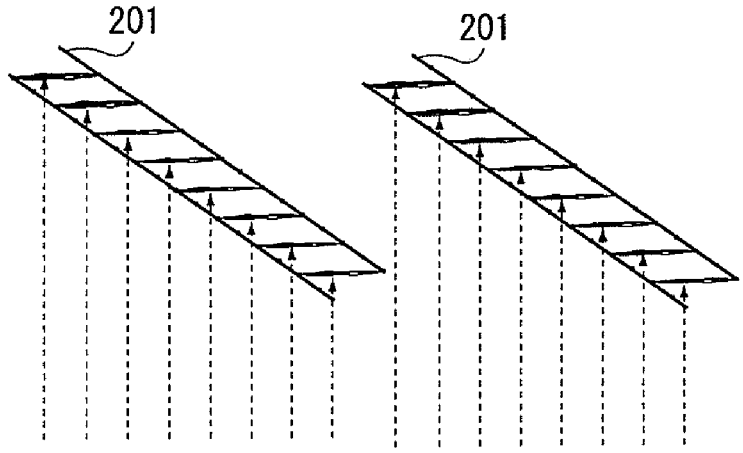
FIG. 12 is a sectional view of the blind shown in FIG. 11.
Figure 13A:
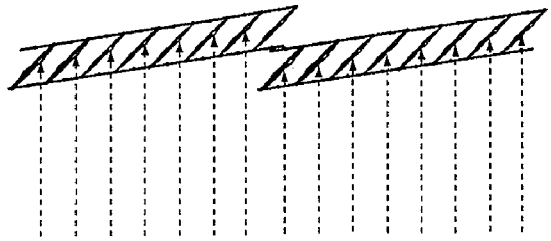
FIG. 13 is a diagram for explaining the light-shielding effect obtained when slats of the blind are rotated.
Figure 13B:
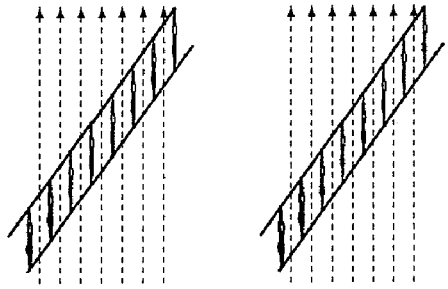
Figure 13C:
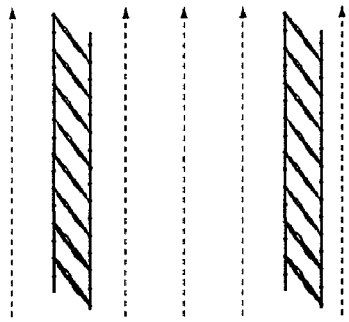
Figure 13D:
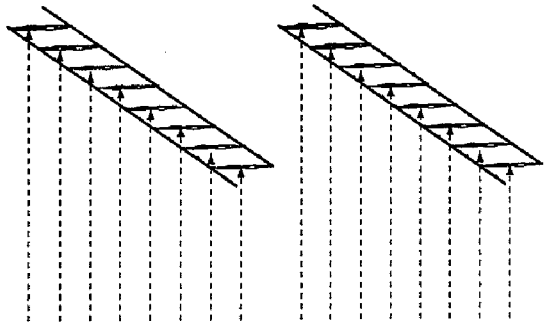
Figure 13E:
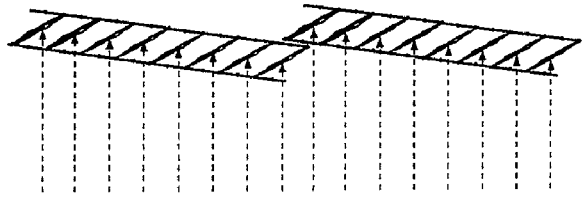
Figure 14:
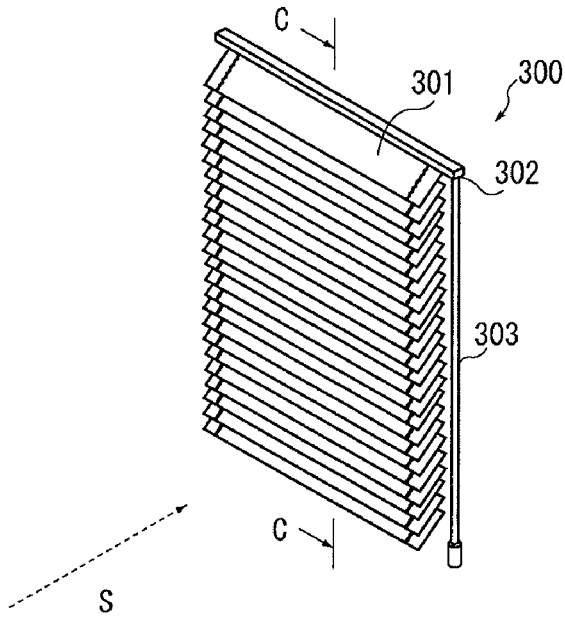
FIG. 14 is a perspective view of another blind.
Figure 15:
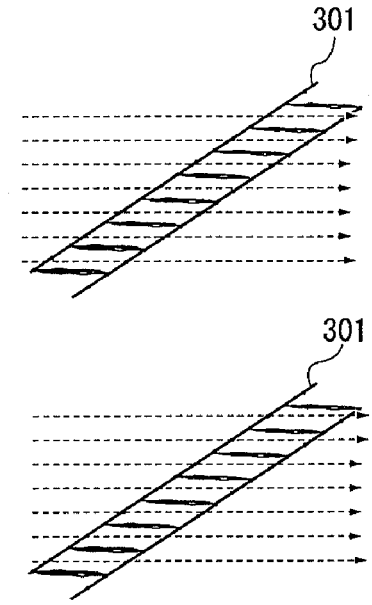
FIG. 15 is a sectional view of the blind shown in FIG. 14.
Figure 16:
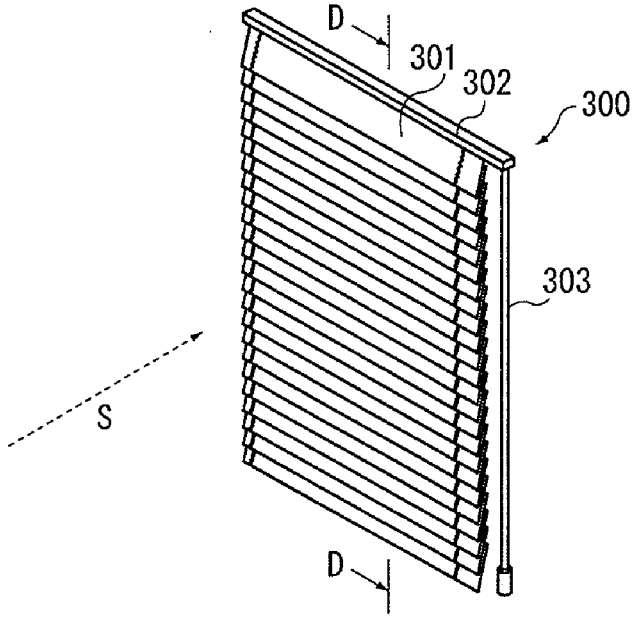
FIG. 16 is a perspective view of the blind shown in FIG. 14, in a closed state.
Figure 17:
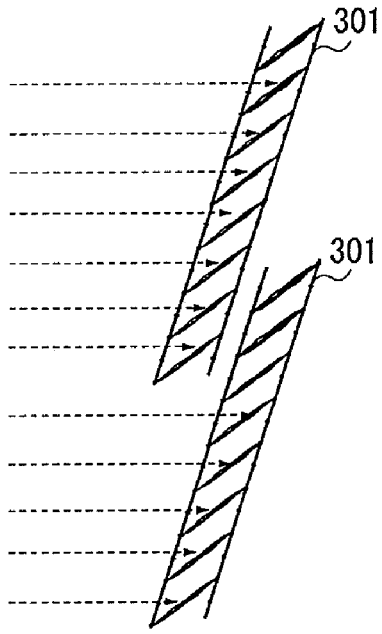
FIG. 17 is a sectional view of the blind shown in FIG. 16.

1: sheet material
2: front fabric
20: stitch rows
21: insertion yarn
3: back fabric
30: stitch rows
31: insertion yarn
4: light-shielding layer

What is claimed is:

1. A light-transmitting sheet material comprising:

a front fabric and a back fabric formed by arranging a plurality of stitch wales of chain stitches which are knitted in a warp direction, in a weft direction at a predetermined interval and by knitting an insertion yarn alternately in adjoining stitch wales by a predetermined length; and a plurality of light-shielding layers, being formed into sheet-like structures in the warp direction by knitting a connecting yarn alternately between the stitch wales of the front and back fabrics, arranged in the weft direction, wherein the stitch wales of the front and back fabrics opposed to each other are connected to adjoining light-shielding layers, wherein the light-shielding layers are formed between the stitch wales of the front and back fabrics, being opposed to each other, located at positions shifted from each other, and wherein entire constituent yarns are fixed by resin treatment so that the front and back fabrics are held with a predetermined distance therebetween, the light-shielding layers are maintained in an oblique state and the sheet material has no movable portion.

2. The light-transmitting sheet material according to claim 1, wherein the front and back fabrics are knitted in such a manner that a pair of the insertion yarns are passed between the adjoining stitch wales while being guided in the weft direction so as to intersect each other and are formed into a grid-like structure with the stitch wales in the warp direction and the insertion yarns in the weft direction.

3. A blind comprising a plurality of slats that are formed of the light-transmitting sheet material according to claim 1 or 2 and are formed into a belt-like shape in which the stitch wales extend in a longitudinal direction.

4. A method for producing a light-transmitting sheet material comprising:

knitting a knitted fabric including a front fabric and a back fabric formed by arranging a plurality of stitch wales of chain stitches which are knitted in a warp direction, in a weft direction at a predetermined interval, knitting an insertion yarn alternately in adjoining stitch wales by a predetermined length, and passing a pair of the insertion yarns between the adjoining stitch wales while guiding them in the weft direction so as to intersect each other and a plurality of light-shielding layers, being formed into sheet-like structures in the warp direction by knitting a connecting yarn alternately between the stitch rows of the front and back fabrics, arranged in the weft direction;

impregnating the resulting knitted fabric with a resin material;

applying tensile force in the weft direction to the knitted fabric impregnated with the resin material, thereby causing the stitch wales of the front and back fabrics to be stretched linearly in the warp direction and the insertion yarns to be stretched linearly between the adjoining stitch wales in the weft direction so as to be formed into a grid-like structure;

setting the resin material while the front and back fabrics are held with a predetermined distance therebetween; and fixing and shaping entire constituent yarns of the knitted fabric such that the stitch wales of the front and back fabrics opposed to each other are connected to adjoining light-shielding layers and such that the light-shielding layers are formed between the stitch wales of the front and back fabrics, being opposed to each other, located at positions shifted from each other and are maintained in an oblique state and such that the sheet material has no movable portion.

* * * * *